US005977020A

United States Patent [19]

Nishioka et al.

[11] Patent Number: 5,977,020

[45] Date of Patent: Nov. 2, 1999

[54] THERMOSENSITIVE REVERSIBLE RECORDING MATERIAL

[75] Inventors: Makoto Nishioka, Yokohama; Kazuo Yamane, Chiba, both of Japan

[73] Assignee: Oji Paper Co., Ltd., Tokyo, Japan

[21] Appl. No.: 09/114,491

[22] Filed: Jul. 13, 1998

[30] Foreign Application Priority Data

Jul. 17, 1997 [JP] Japan ..... 9-192480

[51] Int. Cl.[6] ..... B41M 5/30

[52] U.S. Cl. ..... 503/216; 503/201; 503/217; 503/221; 503/225

[58] Field of Search ..... 503/201, 216, 503/217, 221, 225

[56] References Cited

U.S. PATENT DOCUMENTS

| | | | |
|---|---|---|---|
| 4,762,818 | 8/1988 | Sekine et al. | 503/214 |
| 5,641,724 | 6/1997 | Yamaguchi et al. | 503/221 |

FOREIGN PATENT DOCUMENTS

| | | | |
|---|---|---|---|
| 0 220 515 A1 | 5/1987 | European Pat. Off. | 503/221 |
| 58-191190 | 11/1983 | Japan | 503/201 |

(List continued on next page.)

*Primary Examiner*—Bruce H. Hess
*Attorney, Agent, or Firm*—Nikaido Marmelstein Murray & Oram, LLP

[57] ABSTRACT

A thermosensitive reversible recording material capable of forming and holding clear colored images with a high contrast and capable of being repeatedly color-developed and color-erased many times, has a thermosensitive recording layer formed on substrate sheet and including (A) at least one reversibly color-developing and -erasing compound selected from those of the formulae (I), (II) and (III), and (B) at least one dye precursor compound of the formula (IV).

(I)

(II)

(III)

(IV)

$R^1$=naphyl or lower alkoxy-substituted phenyl group $Y^1$, $Y^2$=—NHCO—, —SCONH—, —CONHCO—, etc., n, m, p=10 to 29, $R^2$, $R^3$, $R^4$, $R^5$=$C_1$–$C_9$ alkyl, $C_3$–$C_6$ cycloalkyl or substituted or non-substituted phenyl group, $R^6$, $R^7$=$C_1$–$C_6$ alkyl or phenyl group.

2 Claims, 1 Drawing Sheet

FOREIGN PATENT DOCUMENTS

| | | | |
|---|---|---|---|
| 60-193691 | 10/1985 | Japan | 503/201 |
| 60-264285 | 12/1985 | Japan | 503/201 |
| 62-140881 | 6/1987 | Japan | 503/200 |
| 63-107584 | 5/1988 | Japan | 503/201 |
| 63-173684 | 7/1988 | Japan | 503/201 |
| 2-188293 | 7/1990 | Japan | 503/201 |
| 2-188294 | 7/1990 | Japan | 503/201 |
| 3-233490 | 10/1991 | Japan | 503/201 |
| 4-78573 | 3/1992 | Japan | 503/201 |
| 4-358878 | 12/1992 | Japan | 503/201 |
| 5-42762 | 2/1993 | Japan | 503/201 |
| 5-124360 | 5/1993 | Japan | 503/201 |
| 6-210954 | 8/1994 | Japan | 503/201 |
| 62-84157 | 4/1997 | Japan | 503/221 |
| 9-272261 | 10/1997 | Japan | 503/201 |

THERMOSENSITIVE REVERSIBLE RECORDING MATERIAL

BACKGROUND OF THE INVENTION (1) Field of the Invention

The present invention relates to a thermosensitive reversible recording material capable of color-developing and color-erasing colored images under controlled heating conditions and of holding the color-developed condition and the color-erased condition of the images at room temperature. More particularly, the present invention relates to a thermosensitive reversible recording material capable of forming colored images having a high contrast on a white ground, having a good image-retention characteristic and capable of being repeatedly color-developed and color-erased many times, without the contrast being decreased.

(2) Description of the Related Art

Generally, since a thermosensitive recording apparatus is compact and inexpensive and is easy to maintain, a thermosensitive recording material has been used as an output sheet for computers, measurement equipment, registers, CDS and ATMS, facsimiles, automatic ticket vending machines, and hand-held terminals and, recently, as a magnetic and thermosensitive recording card for prepaid cards and point cards, in which a magnetic recording facility is added. In conventional magnetic, thermosensitive recording cards, while the magnetic information can be renewed at every use, the thermally recorded images cannot be renewed and additional information, for example, remaining number of uses, must be additionally recorded in a portion of the card free from the recorded images. However, since the area of the portion of the card capable of receiving the additional information is limited, the amount of the thermally recorded information is limited or, when the additional information-recording area is filled, the card must be replaced by a new one. Accordingly, to solve the above-mentioned disadvantages, the development of a thermosensitive reversible recording material capable of repeatedly renewing the record of information has been strongly demanded.

Also, based on a recent emphasis on waste-treatment and forest-preservation, re-use of the thermosensitive recording material is desired. There have been various attempts at developing a re-usable thermosensitive recording material. Especially, development of a thermosensitive reversible recording material capable of repeatedly renewing the recorded information many times has been demanded for wide use as a means which does not need a large-scale apparatus, for example, an ink-removing apparatus.

Also, the thermosensitive reversible recording materials as disclosed in Japanese Unexamined Patent Publications No. 3-233,490 and No. 5-42,762 have attracted public attention as recording materials for simple display, and a thermosensitive reversible recording material suitable for the above-mentioned display apparatus is strongly demanded.

On the basis of the above-mentioned demands, various types of reversible thermosensitive recording materials have been proposed.

For example, in Japanese Unexamined Patent Publications No. 63-107,584, No. 4-78,573 and No. 4-358,878, reversible thermosensitive recording materials utilizing a polymer capable of changing transparency thereof in response to heating conditions are described. However, since these recording materials utilize a transparent-to-opaque changing phenomenon due to a phase transition of the polymer, a satisfactory transparency and a sufficient opacity cannot be easily obtained, the contrast between the color-developed images and the color-erased image traces is low, and naked-eye observation in the dark is difficult. Also, in general, the above-mentioned type of recording materials are disadvantageous in that since white images are recorded on a colored ground of the recording material, a recording material capable of recording colored images on a white ground, namely, a paper-like recording material, is difficult to obtain.

As means for solving the above-mentioned problems of the conventional reversible thermosensitive recording materials, a dye-type reversible thermosensitive recording material using a conventional dye usable for conventional thermosensitive recording materials and a dye developer capable of reversibly color-developing and erasing the dye are known. The dye-type reversible thermosensitive materials can easily record colored images in a white ground, and the resultant recorded images have relatively high contrast. As the above-mentioned dye type reversible thermosensitive recording material, the following systems are known.

In Japanese Unexamined Patent Publications No. 58-191,190 and No. 60-193,691, a system using, as a developing agent, gallic acid or phloroglucinol is described. However, this type of system is disadvantageous in that since erasure of the colored images needs water or water vapor, the color-erasing apparatus must have a large size.

Japanese Unexamined Patent Publications No. 60-264,285 and No. 62-140,881 disclose a system using a thermochronic material with hysteresis. This type of system is disadvantageous in that since the colored image-retaining temperature range is limited in both the upper and lower limits thereof, the apparatus for the system is complicated and there is a limitation on the temperature range usable for practice.

Japanese Unexamined Patent Publication No. 63-173,684 discloses a system using, as a color-developing agent, an ascorbic acid derivative. This system is disadvanteous in that, in erasing the colored images, erasure cannot be fully effected.

Japanese Unexamined Patent Publications No. 2-188,293 and No. 2-188,294 disclose a system in which a salt of a specific organic acid such as gallic acid with a higher aliphatic amine is used as a color-developing agent. This system is, however, disadvantageous in that since the color-developing reaction and the color-erasing reactions are competitive with each other, it is difficult to control the reactions so as to selectively promote only one of the reactions, and colored images with a high contrast are difficult to obtain.

Japanese Unexamined Patent Publications No. 5-124,360 and No. 6-210,954 disclose a system using, as a color-developing agent, a phosphoric acid compound or phenol compound each having a long chain alkyl group. This system is, however, disadvantageous in that the colored images may be not fully erased and the storage property of the colored images may be insufficient.

As mentioned above, although various types of reversible thermosensitive recording material have been disclosed, each of them has various disadvantages. Therefore, no reversible thermosensitive recording material having a practically satisfactory performance has been obtained.

To solve the above-mentioned problems, the inventors of the present invention have provided a thermosensitive reversible recording material in which a specific color-developing agent comprising a compound having a long chain alkyl group and a sulfonyl(thio)urea group is used, as disclosed in Japanese Unexamined Patent Publication No. 9-272,261.

This type of thermosensitive reversible recording material can form colored images having a high contrast and an excellent storage retention on a white ground by using a small, compact printer. The colored images can be repeatedly color-developed and color-erased only by changing the heating condition. However, the recording material is not satisfactory in that an increased number of repeats of the color-developing and erasing operations may cause the erasure of the colored images to become insufficient and thus after the color-erasure, the color density of the resultant residual images to increase.

SUMMARY OF THE INVENTION

An object of the present invention is to provide a thermosensitive reversible recording material capable of forming colored images having a high contrast on a white ground and a good image retention characteristic by using a small, compact printer and capable of being repeatedly color-developed and color-erased only by changing a heating condition, without increasing the color density of residual images after color-erasure, and without decreasing the contrast, even after the color-developing and color-erasing operations are repeated many times.

The above-object can be attained by the thermosensitive reversible recording material of the present invention which comprises a substrate sheet, and a thermosensitive recording layer formed on the substrate sheet and comprising a colorless or light colored dye precursor and a color-developing agent capable of reversibly color-developing and erasing the dye precursor, in which (A) the color-developing agent comprises at least one member selected from the class consisting of the compounds of the general formulae (I), (II) and (III):

(I)

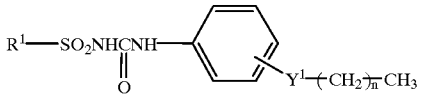

(II)

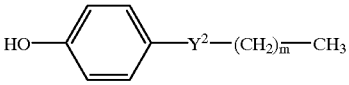

and (III)

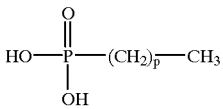

wherein $R^1$ represents a member selected from the class consisting of a naphthyl group, and a phenyl group substituted with at least one lower alkoxy group, $Y^1$ and $Y^2$ respectively and independently from each other represent a member selected from the class consisting of divalent groups of the formulae:

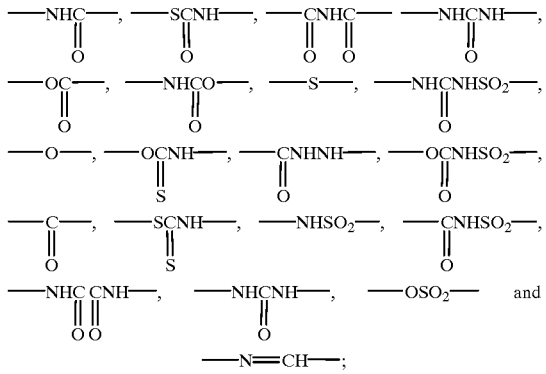

and n, m and p respectively and independently from each other represents an integer of 10 to 29, and (B) the dye precursor comprises at least member selected from the class consisting of the fluoran compounds of the formula (IV):

(IV)

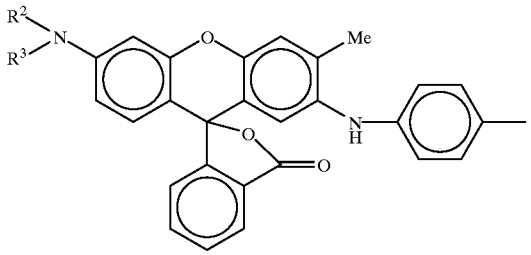

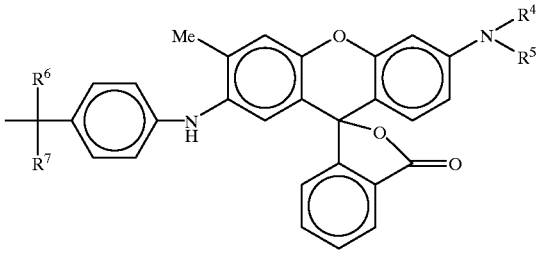

wherein $R^2$, $R^3$, $R^4$ and $R^5$ respectively and independently from each other represents a member selected from the group consisting of alkyl groups with 1 to 9 carbon atoms, cycloalkyl groups with 3 to 6 carbon atoms and a phenyl group which may be substituted with at least one substituent, and $R^6$ and $R^7$ respectively and independently from each other represents a member selected from the class consisting of alkyl group with 1 to 6 carbon atoms, and a phenyl group, and Me represents a methyl group.

In the thermosensitive reversible recording material of the present invention, the fluoran compound of the formula (IV) for the dye precursor is preferably of the formula (V):

(V)

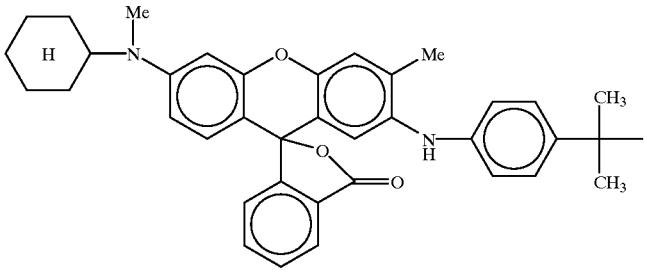

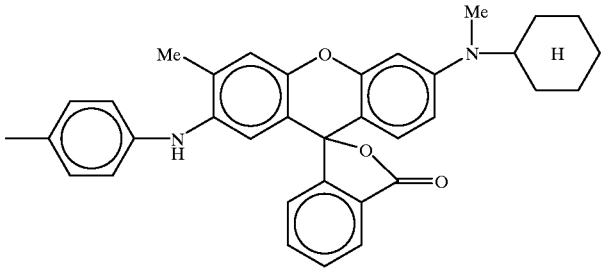

wherein Me is as defined above.

DESCRIPTION OF THE PREFERRED EMBODIMENTS

Figure 1:
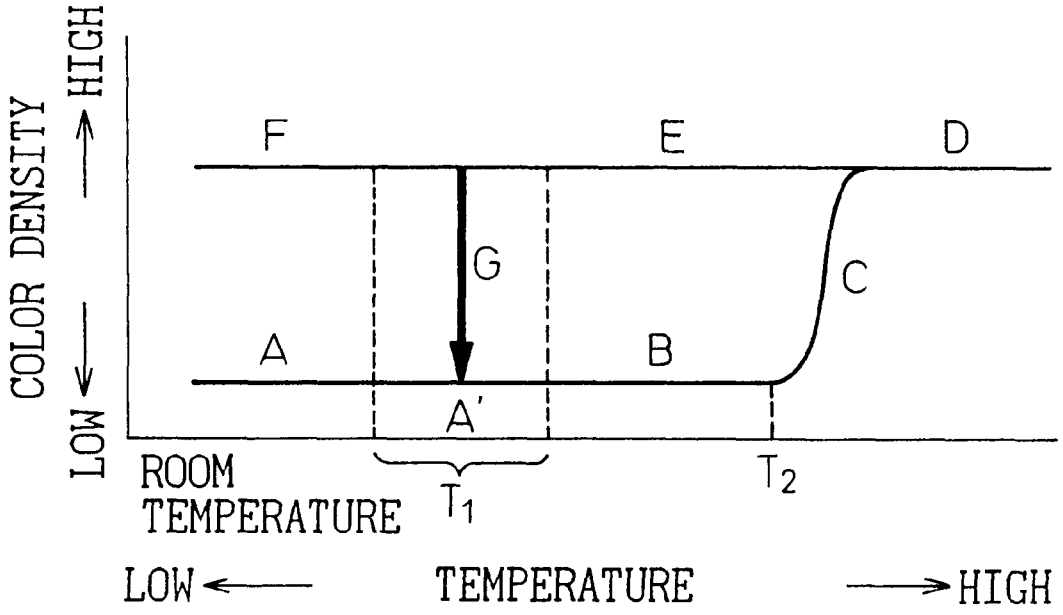
FIG. 1 is a graph showing a relationship between temperature and color density in the color-developing and color-erasing procedure cycle of the thermosensitive reversible recording material of the present invention.

In the thermosensitive reversible recording material, the thermosensitive recording layer comprising a dye precursor and a color-developing agent form a color upon heating, and the resultant color is maintained at room temperature by rapidly cooling the thermosensitive recording layer. Also, the colored images maintained at the room temperature can be erased by heating to a temperature equal to or lower than the color-developing temperature, and the erased image traces can be maintained even when they are cooled to room temperature. Namely, to apply the reversible thermal color-developing and erasing procedures to the thermosensitive recording material of the present invention, it is possible that the colored images are colored-developed and recorded by applying a heating procedure to the thermosensitive recording layer and, after the record is completed, the colored images are erased by applying a heating procedure to the thermosensitive recording layer at a temperature lower than the heating temperature for the color-developing.

In the thermosensitive reversible recording material of the present invention, the color-developing and erasing mechanism is not clear. However, it is assumed that, in the color-developing compound of the formula (I), the urea moiety in the sulfonylurea group is activated by the sulfonyl moiety adjacent thereto and exhibits a high color-developing activity for a basic leuco dye, color-development of the dye occurs, and when the color-formed material is heated to a temperature not higher than the color-developing temperature, the long chain alkyl groups ($-(CH_2)_nCH_3$, $-(CH_2)_mCH_3$ or $-(CH_2)_pCH_3$ groups) in the color-developing compound of the formula (I), (II) or (III) are orientated so as to induce a crystallization of the color-developing compound, and thus the dye is separated from the color-developing compound so as to make the color disappear.

Generally, the heating temperature for the color-development is 80° C. to 180° C., and the heating temperature for the color-erasure is in the range of 50 to 120° C. and lower than the heating temperature for the color-development. Generally, while the color-development is carried out by using a thermal head which is easy to rapidly cool after heating, the color-erasure is carried out by holding the material at a color-erasing temperature range lower than the color-developing temperature, and heating and cooling rates do not need to be controlled. The temperature holding time for color-erasure is preferably 0.1 second or more.

The color-developing and erasing procedures will be explained in detail with reference to FIG. 1.

In FIG. 1, when a non-recorded recording material held in condition A is heated, the temperature of the recording material increases through condition B and the color density rapidly increases at a temperature $T_2$, and after passing through condition C, the color-developing reaction is completed and the recording material reaches condition D and exhibits a highest color density. When the material is rapidly cooled from the condition D to room temperature, the recording material passes through condition E and then reaches condition F. The condition F is a condition in which the developed color is maintained at room temperature, and in the condition F, the recording of the images is completed. When the recorded images are heated and maintained in a temperature range $T_1$, the color density of the images gradually decreases, passed through condition G and reaches condition A' in which the colored images are completely erased. Further, the recording material is cooled to room temperature and reaches condition A. The condition A is a condition in which the color-erased condition is held at room temperature and the color-erasure is complete. The color-developing and erasing cycle is reversible and can thus be repeated.

In the thermosensitive reversible recording material of the present invention, the color-developing agent comprises at least one member selected from the class consisting of the compounds of the general formulae (I), (II) and (III):

(I)

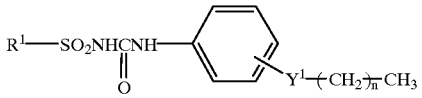

(II)

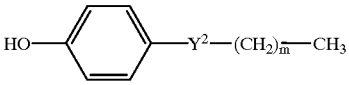

and (III)

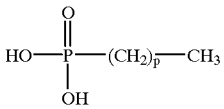

In the formula (I), $R^1$ represents a member selected from the class consisting of naphthyl groups and phenyl groups substituted with at least one lower alkoxy group, preferably having 1 to 4 carbon atoms, for example, $CH_3O$—, $C_2H_5O$—, $C_3H_7O$— and $C_4H_9O$—.

The naphthyl group represented by $R^1$ is selected from those of the formulae:

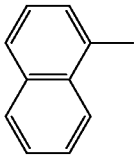

and

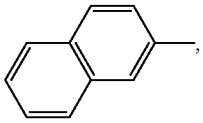

In the formula (I) and (II) and (III), $Y^1$ and $Y^2$ each respectively and independently from each other represent a member selected from the class consisting of the divalent groups of the formulae:

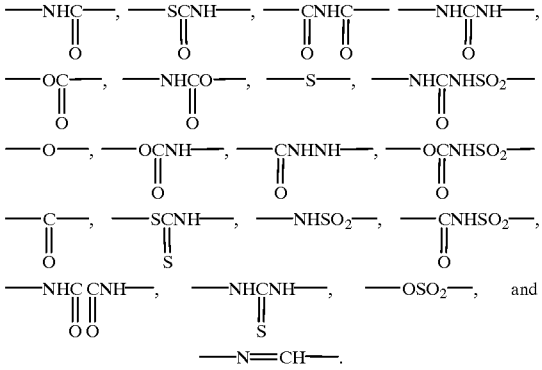

In the formulae (I), (II) and (III), n, m and p respectively and independently from each other represent an integer of 10 to 29.

The long chain alkyl groups represented by $-(CH_2)_nCH_3$, $-(CH_2)_mCH_3$ and $-(CH_2)_pCH_3$ contains carbon atoms in the number of 11 to 30, preferably 14 to 21. When the carbon number of the long chain alkyl group is less than 11, the resultant color-developing compound exhibits an insufficient color-erasing property in practical use. Also, when the carbon number of the long chain alkyl group is more than 30, the resultant color-developing compound exhibits an insufficient color-developing activity and thus is unsatisfactory in practice.

The aromatic compound of the formula (I) for the color-developing agent is preferably selected from those of the formulae shown below.

| Compound No. | Chemical Formula |
|---|---|
| I-1 | 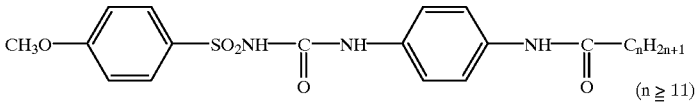 |
| I-2 | 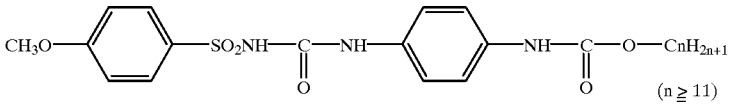 |
| I-3 | 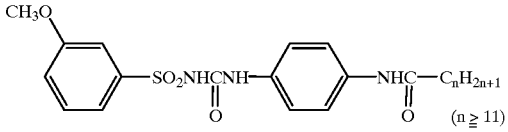 |
| I-4 | 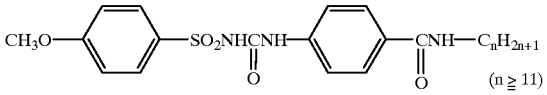 |

-continued
| Compound No. | Chemical Formula |
|---|---|
| I-5 | 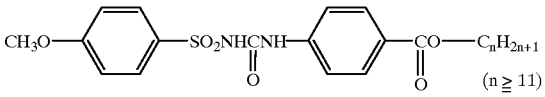 |
| I-6 | 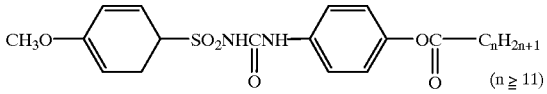 |
| I-7 | 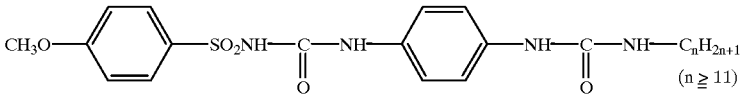 |
| I-8 | 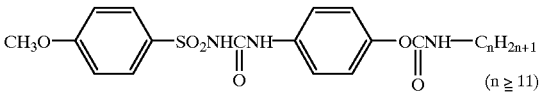 |
| I-A-9 | 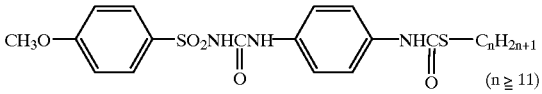 |
| I-A-10 | 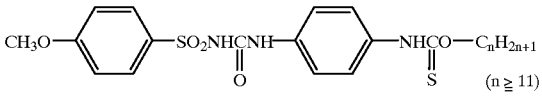 |
| I-A-11 | 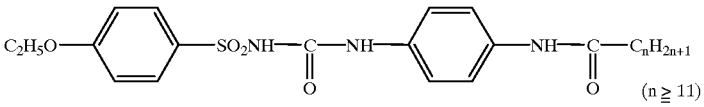 |
| I-A-12 | 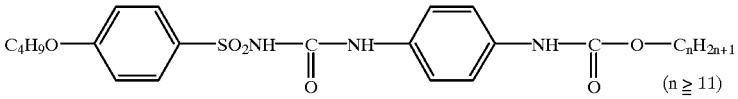 |
| I-A-13 | 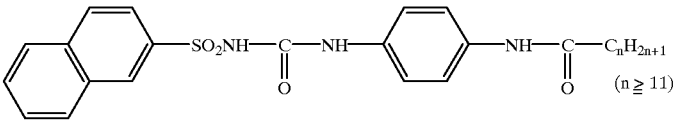 |
| I-A-14 | 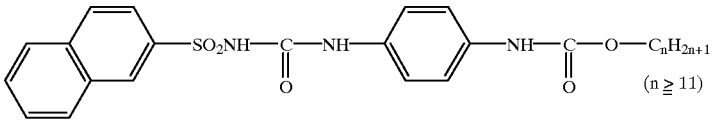 |
| I-A-15 | 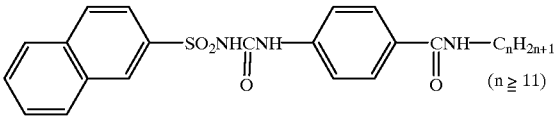 |
| I-A-16 | 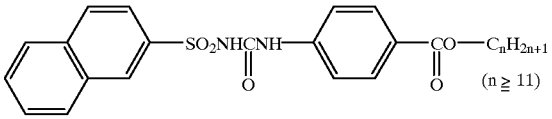 |

-continued
| Compound No. | Chemical Formula |
|---|---|
| I-17 | 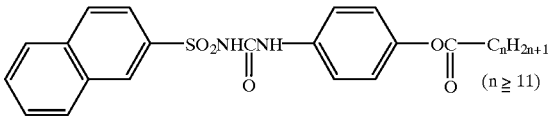 |
| I-18 | 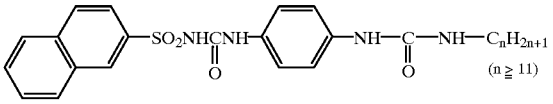 |
| I-19 | 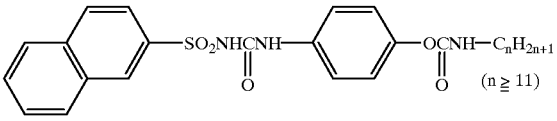 |
| I-20 | 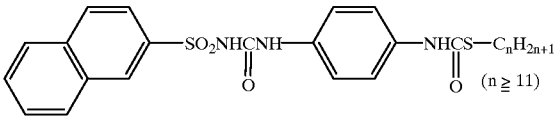 |
| I-21 | 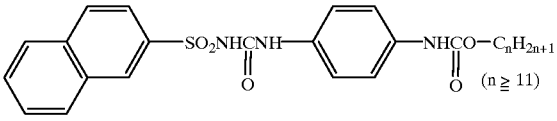 |
| I-22 | 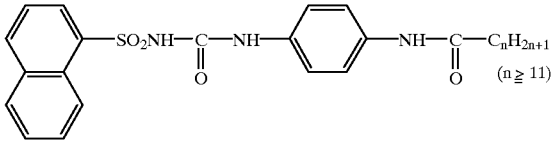 |
| I-23 | 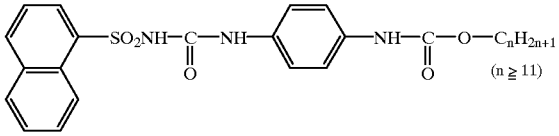 |
| I-24 | 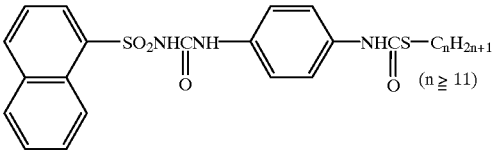 |

The aromatic color-developing compound of the general formula (II) is preferably selected from those of the formulae as shown below.

| Compound No. | Chemical Formula |
|---|---|
| II-1 | 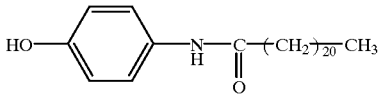 |
| II-2 | 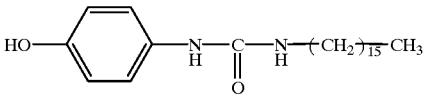 |
| II-3 | 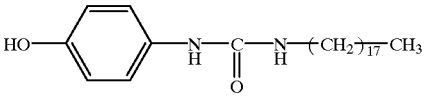 |
| II-4 | 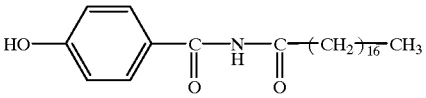 |
| II-5 | 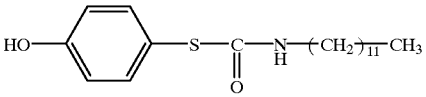 |
| II-6 | 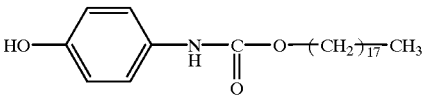 |
| II-7 | 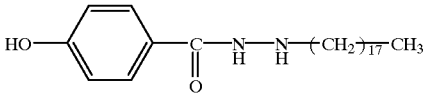 |
| II-8 | 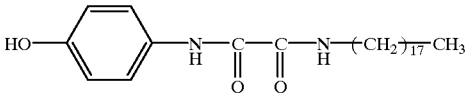 |

The color-developing compound of the formula (III) for the color-developing agent is preferably selected from those of the formulae as shown below.

| Compound No. | Chemical Formula |
|---|---|
| III-1 | 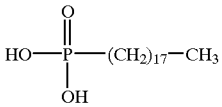 |
| III-2 | 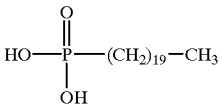 |

-continued

| Compound No. | Chemical Formula |
|---|---|
| III-3 | 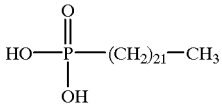 |

The above-mentioned color-developing compounds of the formulae (I), (II) and (III) can be employed alone or in a mixture of two or more thereof.

In the thermosensitive reversible recording material of the present invention, the dye precursor comprises at least one member selected from the class consisting of the fluoran compounds of the formula (IV):

(IV)

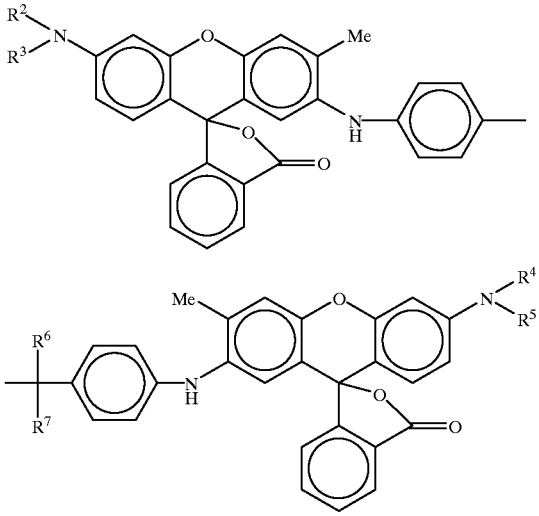

wherein $R^2$, $R^3$, $R^4$ and $R^5$ respectively and independently from each other represent a member selected from the group consisting of alkyl groups with 1 to 9 carbon atoms, for example, methyl, ethyl, propyl and butyl groups, cycloalkyl groups with 3 to 6 carbon atoms, for example, cyclopropyl, cyclobutyl, cyclopentyl and cyclohexyl groups and a phenyl group which may be substituted with at least one substituent selected from, for example, methyl, ethyl, and isopenthyl group, and $R^6$ and $R^7$ respectively and independently from each other represent a member selected from the class consisting of alkyl group with 1 to 6 carbon atoms, for example, methyl, ethyl and isobutyl and hexyl groups and a phenyl group, and Me represents a methyl group.

The dye precursor compound is preferably selected from those of the formulae as shown below.

| Compound No. | Chemical Formula |
|---|---|
| IV-1 | 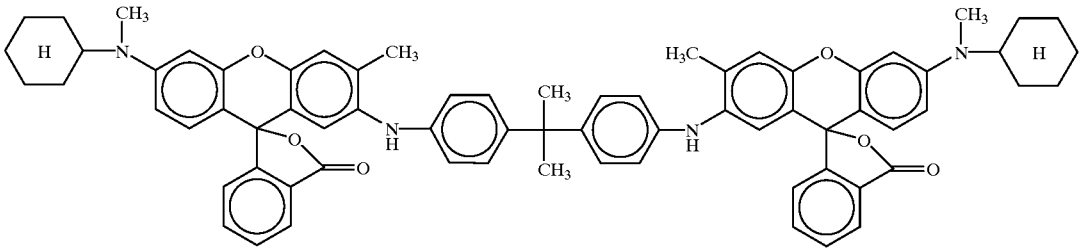 |
| IV-2 | 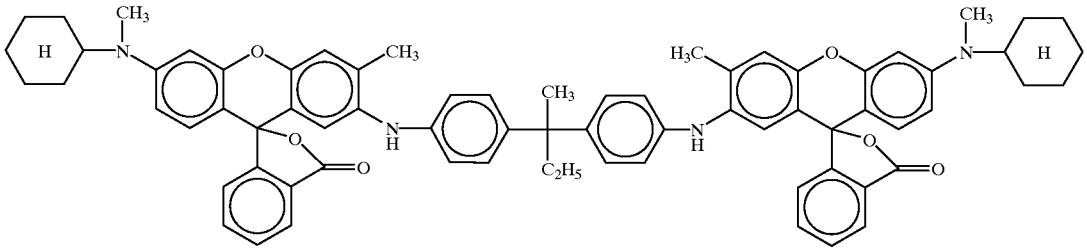 |
| IV-3 | 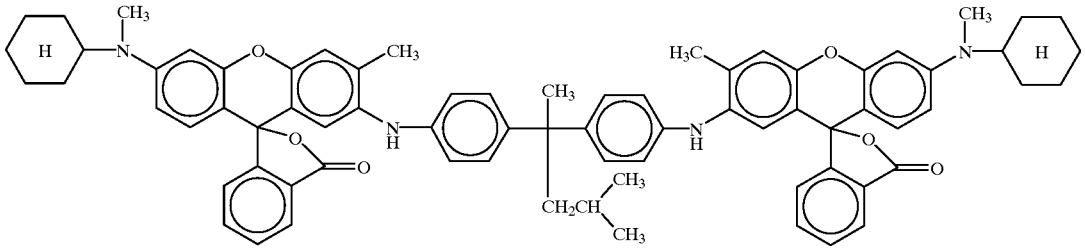 |
| IV-4 | 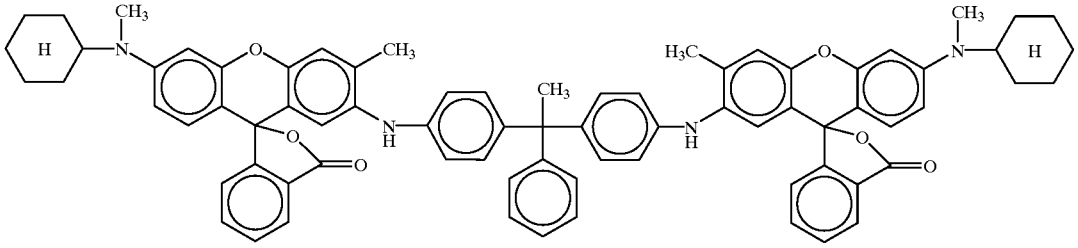 |
| IV-5 | 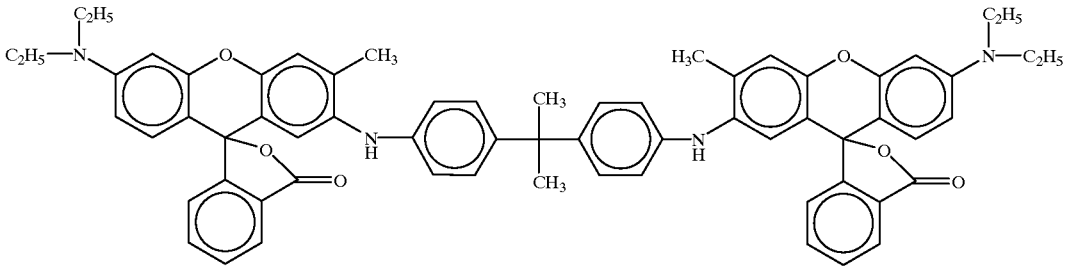 |

-continued
| Compound No. | Chemical Formula |
|---|---|
| IV-6 | 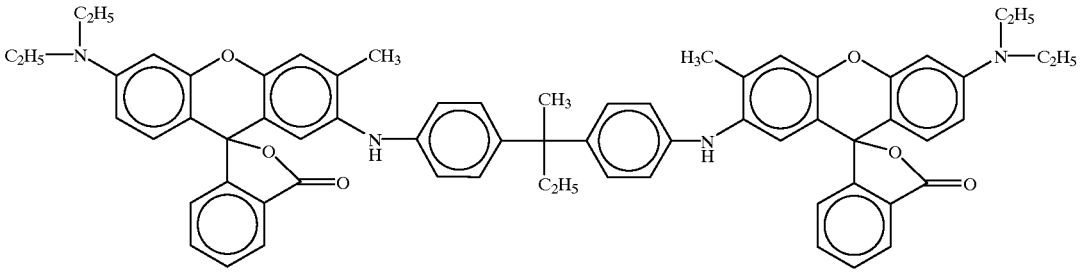 |
| IV-7 | 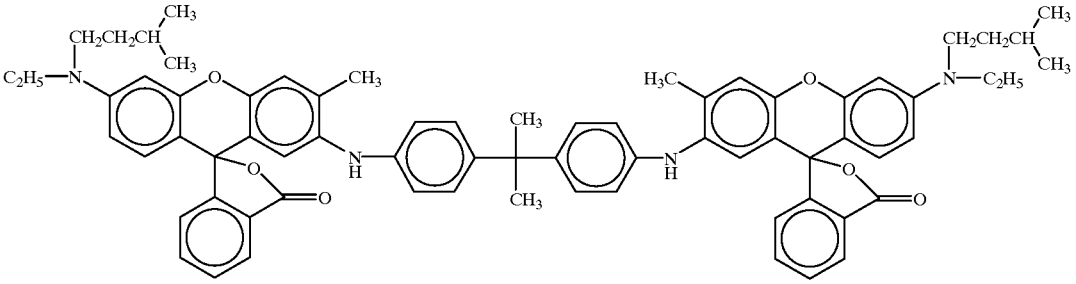 |
| IV-8 | 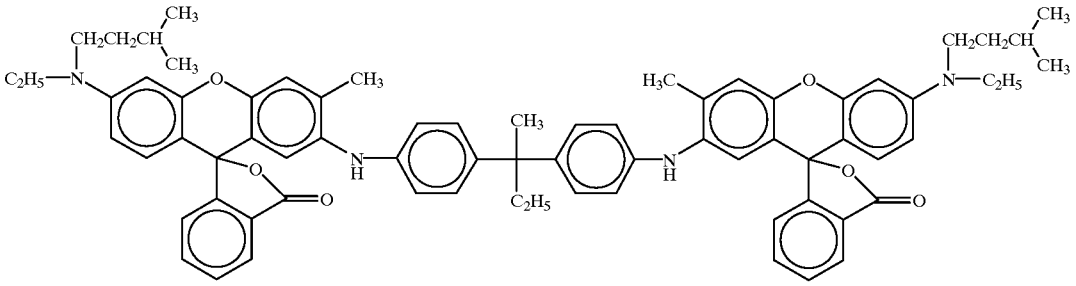 |
| IV-9 | 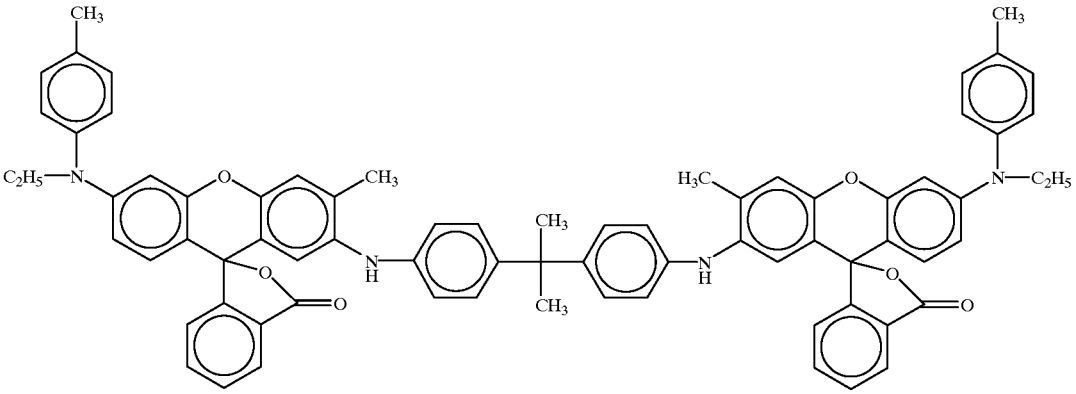 |

-continued

| Compound No. | Chemical Formula |
|---|---|
| IV-10 | 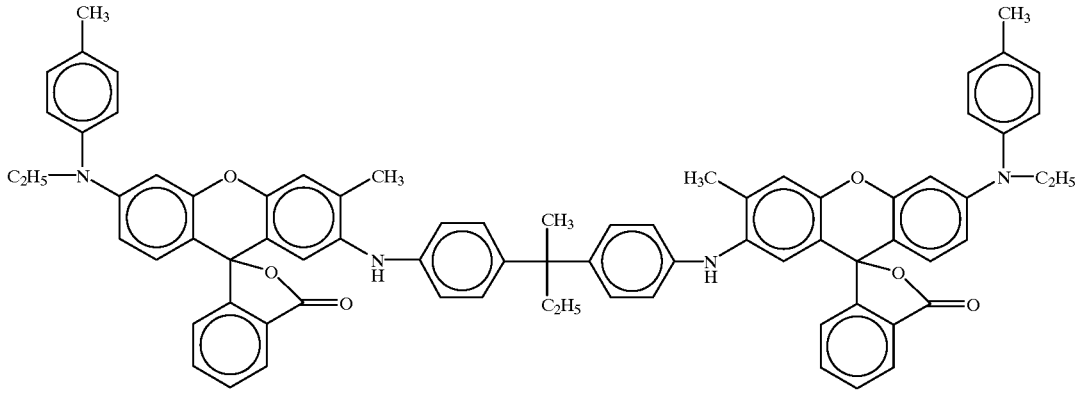 |

Among the dye precursor compounds of the formula (IV), preferably 2,2-bis{4-[6'-N-cyclohexyl-N-methylamino-3'-methylspiro[phthalido-3,9'-xanthene]-2'-ylamino]phenyl}propane (Compound No. IV-1) of the formula (V):

(V)

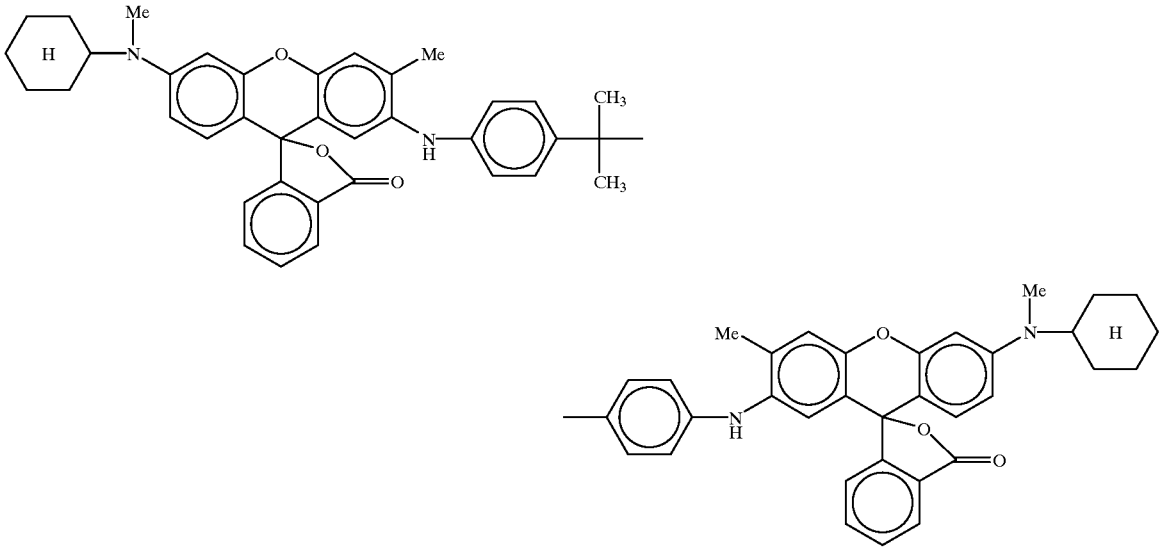

wherein Me represents a methyl group.

In the present invention, the color-developing compounds of the formulae (I), (II) and/or (III) may be employed together with a conventional color-developing agent comprising phenolic compounds, organic carboxylic acids and aromatic sulfonyl(thio) urea compounds having no long chain alkyl group, as long as the conventional color-developing agent does not obstruct the desired effect of the present invention.

The conventional color-developing agent may be selected from 2,2-bis(4-hydroxyphenyl)propane(bisphenol A), 1,1-bis(4-hydroxyphenyl)-1-phenylethane, 1,4-bis[1-methyl-1-(4'-hydroxyphenyl)ethyl]benzene, 1,3-bis[1-methyl-1-(4'-hydroxyphenyl)ethyl]benzene, dihydroxydiphenylether (Japanese Unexamined Patent Publication No. 1-180,382), benzyl p-hydroxy-benzoate (Japanese Unexamined Patent Publication No. 52-140,483), bisphenol S, 4-hydroxy-4'-isopropyloxydiphenylsulfone (Japanese Unexamined Patent Publication No. 60-13,852), 1,1-di-(4-hydroxyphenyl)-cyclohexane, 1,7-di(4-hydroxyphenylthio)-3,5-dioxaheptane (Japanese Unexamined Patent Publication No. 59-52,694), 3,3'-dialkyl-4,4'-dihydroxydiphenyl-sulfone (Japanese Unexamined Patent Publication No. 60-208,286), N-(p-toluenesulfonyl)-N'-phenylurea, N-(p-toluenesulfonyl)-N'-p-methoxyphenyl)urea, N-(p-toluenesulfonyl)-N'-(o-tolyl)urea, N-(p-toluenesulfonyl)-N'-(m-tolyl)urea, N-(p-toluenesulfonyl)-N'-(p-tolyl)urea, N-(p-toluenesulfonyl)-N'-benzylurea (the above 6 compounds are disclosed in Japanese Unexamined Patent Publication (Kokai) No. 5-32,061), and 4,4'-bis(p-toluenesulfonyl-aminocarbonylamino)-diphenylmethane, 4,4'-bis(o-toluenesulfonylaminocarbonylamino)disphenylmethane, 4,4'-bis(benzenesulfonylaminocarbonylamino) diphenylmethane, 1,2-bis[4'-(p-toluenesulfonylaminocarbonylamino) phenyloxy]ethane, 4,4'-bis(p-toluenesulfonyl-aminocarbonylamino) disphenylether, and 3,3'-bis(p-toluenesulfonylaminocarbonylamino) diplienylsulfone (the above 6 compounds are disclosed in Japanese Unexamined Patent Publication (Kokai) No. 5-147,357).

In the thermosensitive reversible recording material of the present invention, the thermosensitive recording layer optionally contains a heat-fusible substance which is commonly known as a sensitizing agent or a color-erasing promotor.

The sensitizing agent may be selected from, for example, oxalic acid diesters (Japanese Unexamined Patent Publication No. 64-1,583), di(4-methylbenzyl) oxalate (Japanese Examined Patent Publication No. 5-62,597, 1,2-bis(m-tolyloxy)ethane (Japanese Unexamined Patent Publication No. 60-56,588), diphenylsulfone (Japanese Unexamined Patent Publication No. 60-15,667), N-benzylbiphenyl (Japanese Unexamined Patent Publication No. 60-82,382), and [1,4-bis{2-(4-methylbenzyloxy)ethoxy]benzene. These compounds have such a characteristic that the color-development of the thermosensitive reversible recording material can be effected at an increased color density and further such a characteristic that the color-erasing reaction is promoted and the reversibility is enhanced.

The color-erasing promotor comprises, for example, at least one aromatic compound of the general formula:

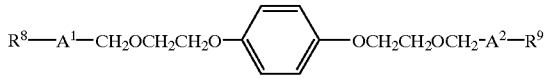

In the formula, $A^1$ and $A^2$ respectively and independently from each other represent a member selected from the class consisting of naphthyl and phenyl groups, and $R^8$ and $R^9$ respectively and independently from each other represent a member selected from the class consisting of a hydrogen atom, lower alkyl groups preferably having 1 to 4 carbon atoms, for example, methyl, ethyl, propyl and butyl; lower alkoxy groups, preferably having 1 to 4 carbon atoms, for example, methoxy, ethoxy, propoxy and butoxy; aryl groups, for example, phenyl and naphthyl; hologen atoms such as fluorine, chlorine, bromine and iodine; and aralkyl groups, for example, benzyl, and biphenyl.

Among the above-mentioned color-erasing promoter compounds, the compound No. 33, 1,4-bis{2-(4-methylbenzyloxy)ethoxy}benzene is particularly useful for the thermosensitive reversibly recording material.

In the present invention, the thermosensitive recording layer may further contain waxes and pigments in an amount which does not hinder the effect of the present invention.

The waxes may be selected from conventional waxes, for example, paraffins, amide-based waxes, bisimide-based waxes and metal salts of higher fatty acids. However, it is preferable that, since a zinc salt of a higher fatty acid contained, as a wax, in a large amount in the thermosensitive recording layer may cause the color-erasing effect to be decreased with increase in the repeating numbers of color-developing and erasing procedures, and the erasure of the colored images to be imperfect, the addition amount of the higher fatty acid zinc salt wax is 1% or less based on the total dry weight of the thermosensitive recording layer.

As the above-mentioned pigments, for example, inorganic fine particles, for example, silica, clay, calcined clay, talc, calcium carbonate, zinc oxide, titanium dioxide, aluminum hydroxide, zinc hydroxide, barium sulfate, and surface-treated calcium carbonate and silica fine particles; and organic fine particles, for example, urea-formaldehyde resin, styrene-methacrylic acid copolymer and polystyrene resin fine particles may be used.

The above-mentioned components of the thermosensitive recording layer of the thermosensitive reversible recording material of the present invention are bonded to the substrate sheet with a binder. For the binder, use may be made of water-soluble polymeric materials, for example, various types of polyvinyl alcohols which have different molecular weights from each other, starch and derivatives thereof, cellulose derivatives, for example, methoxy cellulose carboxymethyl cellulose, methyl cellulose, ethyl cellulose, etc.; sodium polyacrylate, polyvinyl pyrrolidine, acrylic acid amide-acrylic acid ester copolymer, acrylic acid amide-acrylic acid ester-methacrylic acid terpolymer, alkali metal salt of styrene-maleic anhydride copolymer, polyacrylamide, sodium alginate, gelatine, casein, and so on; and latexes of polyvinyl acetate, polyrethane, styrene-butadiene copolymer, polyacrylic acid, polyacrylic acid ester, vinyl chloride-vinyl acetate copolymer, polybutyl methacrylate, ethylene-vinyl acetate copolymer, styrene-butadiene-acrylic terpolymer, etc.

In the thermosensitive recording layer of the thermosensitive reversible recording material of the present invention, preferably the dye precursor is contained in a content of 5 to 40% by weight, the color-developing agent is in a content of 5 to 50% by weight, based on the total dry weight of the thermosensitive recording layer. If the content of the color-developing agent is less than 5% by weight, the resultant thermosensitive recording layer may exhibit an unsatisfactory color-developing performance. Also, when the content is more than 50% by weight, the color-developing performance may be saturated, the contrast between the color density in the color-developed condition and that in the color-erased condition may not be specifically enhanced, and thus an economical disadvantage may occur.

Also, generally the content of the sensitizing agent is preferably 5 to 50% based on the dry weight of the thermosensitive recording layer. When the content of the sensitizing agent is less than 5% by weight, the color-erasion-promoting effect may be insufficient, and when the content is more than 50% by weight, the color density of the colored images may be insufficient.

When the thermosensitive recording layer contains a conventional color-developing agent comprising at least one member selected from phenolic compounds, organic acids and an aromatic sulfonyl(thio)-urea compound having no long chain alkyl group, the content of the conventional color-developing agent in the thermosensitive recording layer is preferably 10% by weight or less based on the total weight of the thermosensitive recording layer.

When the content of the conventional color-developing agent is more than 10% by weight, the color-erasure reaction may be obstructed and the contrast between the color-developed area and the color-erased area in the recording material may be reduced.

When waxes and pigments are contained in the thermosensitive recording layer, the contents thereof are preferably 5 to 20% by weight, and 10 to 50% by weight, respectively. Also, the content of the binder is 5 to 20% by weight in general.

The substrate sheet usable for the thermosensitive reversible recording material is selected from paper sheets (including acidic and neutral paper sheets), coated paper sheets produced by coating a pigment or latex on the surface thereof, laminate paper sheets, synthetic paper sheets produced from, for example, a polyolefin resin, plastic films, for example, polyolefin, polyester and polyimide films, glass plates and elecroconductive rubber sheets, which are usually used for the conventional thermosensitive recording sheets. On at least one surface of the substrate sheet, a coating liquid containing the above-mentioned necessary components is coated and dried to provide a thermosensitive reversible recording material. The thermosensitive recording layer is preferably in an amount of 1 to 15 g/m$^2$, more preferably 2 to 10 g/m$^2$ on a dry basis.

In the thermosensitive reversible recording material of the present invention, optionally, an undercoat layer is formed between the thermosensitive reversible colored image-forming layer and the substrate sheet.

Also, on a back surface of the thermosensitive reversible recording material of the present invention, a back layer may be formed to prevent a blocking phenomenon occurred when surfaces of the recording materials are brought into contact with each other, to restrict the penetration of water and oily substances through the back surface, and to control the curling of the recording material.

Further, for the purpose of enhancing the heat resistance, printing aptitude, and durability to the repeated color-developing and color-erasing operations, the thermosensitive recording layer may be coated with an overcoat layer, for example, a protective layer or printing layer. Further, an intermediate layer is optionally formed between the thermosensitive recording layer and the overcoat layer.

In the present invention, to enhance the added value of the thermosensitive reversible recording material, the material may be further processed to impart an enhanced function thereto. For example, by applying a coating with a pressure-sensitive adhesive, a rewetting adhesive or a delayed tack adhesive to the back surface of the thermosensitive reversible recording material, a pressure-sensitive adhesive sheet, rewet adhesive sheet or delayed tack sheet can be obtained. Also, by furnishing the back surface with a magnetically recordable layer, a thermosensitive reversible recording material capable of magnetic recording can be obtained. Also, a function as a thermal transfer sheet, an ink jet recording sheet, a non-carbon recording sheet, a static recording sheet or a xerographic recording sheet may be imparted to the back surface of the reversible recording material, to provide a recording sheet capable of recording on two surfaces thereof. Of course, a two surface reversible recording material can be obtained.

The heating means for color-developing and erasing can be selected, in response to the purpose of use, from thermal head, constant temperature bath, heating roller, heating pen, facing heat-generating element, laser beam and infrared rays. However, the heating means are not limited to the above-mentioned ones.

EXAMPLES

The present invention will be further explained by the following examples.

In the examples, the terms "part" and "%" refer to "part by weight" and "% by weight", respectively unless specifically indicated.

Example 1

A thermosensitive reversible recording sheet was prepared by the following procedures.

| (1) Preparation of dispersion A<br>Component | Amount (part) |
|---|---|
| 2,2-bis{4-[6'-(N-cyclohexy-N-methylamino)-3'-methylspiro(phthalido-3,9'-xanthene)-2'-ylamino] phenyl}propane (Compound No. IV-1) | 20 |
| 10% polyvinyl alcohol solution | 10 |
| Water | 70 |

The above-mentioned composition was pulverized by using a sand grinder to such an extent that the average size of the particles reached a level of 1 $\mu$m or less.

| (2) Preparation of dispersion B<br>Component | Amount (part) |
|---|---|
| N-(p-methoxybenzenesulfonyl)-N'-[4-(n-octadecanoylamino)phenyl]urea (Compound No. I-1, n = 17) | 20 |
| 10% polyvinyl alcohol solution | 10 |
| Water | 70 |

The above-mentioned composition was pulverized by using a sand grinder to such an extent that the average size of the particles reached a level of 1 $\mu$m or less.

| (3) Preparation of dispersion C<br>Component | Amount (part) |
|---|---|
| 1,4-bis{2-(4-methylbenzyloxy)-ethoxy}]benzene | 20 |
| 10% polyvinyl alcohol solution | 10 |
| Water | 70 |

The above-mentioned composition was pulverized to such an extent that the average size of the particles reached a level of 1 $\mu$m or less.

(4) Formation of Reversible Thermosensitive Recording Layer

A coating liquid was prepared by mixing 75 parts of the dispersion A, 150 parts of the dispersion B and 75 parts of the dispersion C with 30 parts of calcined clay, 2 parts of a 25% paraffin wax emulsion and 100 parts of a 10% polyvinyl alcohol aqueous solution, and agitating the mixture. The coating liquid was coated on a surface of a substrate sheet consisting of a polyester film having a thickness of 188 $\mu$m and dried, to form a reversible thermosensitive recording layer having a dry weight of 5.0 g/m$^2$.

(5) Formation of Intermediate Layer

A coating liquid for an intermediate layer was prepared by mixing 5 parts of an aqueous kaolinite clay dispersion having a solid content of 60% with 200 parts of an aqueous carboxylic acid-modified polyvinyl alcohol solution having a solid content of 10%, while stirring the mixture.

The coating liquid was coated on the surface of the thermosensitive recording layer obtained as mentioned in section (4) and dried to form an intermediate layer having a dry weight of 1.5 g/m$^2$ on the thermosensitive recording layer.

(6) Super Calender Treatment

The thermosensitive sheet as prepared by the above-mentioned procedures was treated by a super calender to provide a calenderd surface having a smoothness of 3000 to 5000 seconds. A thermosensitive reversible recording sheet was obtained.

(7) Formation of Overcoat Layer

A coating liquid for an overcoat layer was prepared by mixing 40 parts of a polyester acrylate (Aronix® M-8030, made by Toa Gosei K.K), with 40 parts of a polyester acrylate (Aronix® M-6200, made by Toa Gosei K.K.) and 20 parts of precipitated calcium carbonate (Liton A®, made by Bihoku Funkakogyo K.K.) and agitating the mixture. The coating liquid was coated on the calender-treated intermediate barrier layer mentioned in section (6) to form a coating layer in an amount of 2.5 g/m$^2$. To the resultant coating layer, an electron beam was irradiated in an electron beam-irradiation chamber having an oxygen concentration of 300 ppm or less, under an acceleration voltage of 175 kV at an absorption dose of 3 Mrad, to form an overcoat layer. A thermosensitive reversible recording material was obtained.

(8) Color-developing and -erasing Test

A specimen of the thermosensitive reversible recording sheet as mentioned above was subjected to a printing procedure using a thermosensitive color-developing tester THPMD made by Okura Denki under a printing voltage of 21.7V at a printing pulse of 1.0 ms. The color density of the resultant colored images was measured by a Macbeth Reflection Color Density Tester RD-914. The test result is shown in Table 1.

Further, the color-developed specimen was heated in a thermal inclination tester made by Toyo Seiki at a temperature of 100° C. under a pressure of 1 kg/cm$^2$ for a heating time of 1 second. Then, the color density of the color erased images was measured by the Macbeth Reflection Color Density Tester RD-914. The test result is shown in Table 1.

(9) Heat Resistance Test

After the color density of the colored images of the color-developed specimen was measured by the above-mentioned test (8), the color-developed specimen was left to stand at a temperature of 50° C. for one day. Thereafter, the color density of the colored images was measured by the same manner as above. The storage property of the colored images was evaluated by the colored image retention: [(color density of the colored images after the one day storage test at 50° C.)/(color density of the colored images immediately after printing)]×100(%). The test result is shown in Table 1.

(10) Moisture Resistance Test

After the color density of the colored images of the color-developed specimen was measured by the above-mentioned test (8), the resultant specimen was left to stand at a temperature of 40° C. at a humidity of 90% for one day. Thereafter, the color density of the colored images was measured by the same testing procedure as above. The storage property of the colored images was evaluated by the colored image retention: [(color density of the colored images after the one day storage test at 40° C. temperature at 90% humidity)/(color density of the colored images immediately after printing)]×100(%). The test result is shown in Table 1.

Example 2

A thermosensitive reversible recording sheet was prepared and tested by the same procedures as in Example 1 with the following exceptions.

In the preparation of the dispersion A, the 2,2-bis{4-[6'-(N-cyclohexyl-N-methylamino)-3'-methylspiro(phthalido-3,9'-xanthene)-21-ylamino]phenyl}propane (Compound No. VI-1) was replaced by 2,2-bis{4-[6'-(N-cyclohexyl-N-methylamino)-3'-methylspiro(phthalido-3,9'-xanthene)-2'-ylamino]phenyl}butane (Compound No. IV-2).

The test results are shown in Table 1.

Example 3

A thermosensitive reversible recording sheet was prepared and tested by the same procedures as in Example 1 with the following exceptions.

In the preparation of the dispersion A, the 2,2-bis{4-[6'-(N-cyclohexyl-N-methylamino)-3'-methylspiro(phthalido-3,9'-xanthene)-2'-ylamino]phenyl}propane (Compound No. VI-1) was replaced by 2,2-bis{4-[6'-(N,N-diethylamino)-3'-methylspiro(phthalido-3,9'-xanthene)-2'-ylamino]phenyl}propane (Compound No. IV-5).

The test results are shown in Table 1.

Example 4

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino)phenyl]urea (Compound No. I-1, n=17) was replaced by N-(2-naphthylsulfonyl)-N'-[4-(n-octadecanoylamino)phenyl]urea (Compound No. I-13, n=17). The test results are shown in Table 1.

Example 5

A thermosensitive reversible recording sheet was prepared and tested by the same procedures as in Example 1 with the following exceptions.

The overcoat layer was formed by the following procedures.

A coating liquid comprising an ultra-violet ray-curable vehicle (trademark: SEIKABEAM PPC-D-9 (MODIFIED), made by DAINICHI SEIKAKOGYO K.K.) was coated on the calendered intermediate layer surface to form a coating layer having a dry weight of 2 g/m$^2$ by using an offset printer. Then, the coating layer was cured by irradiating ultraviolet rays from an ultraviolet ray-curing apparatus having one 1.2 kw mercury lamp located at a distance of 1 cm from the coating layer at a transportation velocity of 15 m/minute, to form an overcoat layer.

The results are shown in Table 1.

Example 6

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea (Compound No. I-1, n=17) was replaced by N-(4-hydroxyphenyl)-N'-octadecylurea (Compound No. II-3).

The test results are shown in Table 1.

Example 7

A thermosensitive reversible recording sheet was prepared and tested by the same procedures as in Example 1 with the following exceptions.

In the preparation of the dispersion B, the N-(p-methoxybenzenesulfonyl)-N'-[4-(n-octadecanoylamino) phenyl]urea (Compound No. I-1, n=17) was replaced by octadecylphosphonic acid (Compound No. III-1).

The test results are shown in Table 1.

Comparative Example 1

A thermosensitive reversible recording sheet was prepared and tested by the same procedures as in Example 1 with the following exceptions.

In the preparation of the dispersion A, the 2,2-bis{4-[6'-(N-cyclohexyl-N-methylamino)-3'-methylspiro(phthalido-3,9'-xanthene)-2'-ylamino]phenyl} propane (Compound No. VI-1) was replaced by 3-(N-ethyl-N-n-hexylamino)-6-methyl-7-anilinofluoran.

The test results are shown in Table 1.

Comparative Example 2

A thermosensitive reversible recording sheet was prepared and tested by the same procedures as in Example 1 with the following exceptions.

In the preparation of the dispersion A, the 2,2-bis{4-[6'-(N-cyclohexyl-N-methylamino)-3'-methylspiro(phthalido-3,9'-xanthene)-2'-ylamino]phenyl} propane (Compound No. VI-1) was replaced by 3-(N-ethyl-N-p-toluidino)-6-methyl-7-anilinofluoran.

The test results are shown in Table 1.

Comparative Example 3

A thermosensitive reversible recording sheet was prepared and tested by the same procedures as in Example 1 with the following exceptions.

In the preparation of the dispersion A, the 2,2-bis{4-[6'-(N-cyclohexyl-N-methylamino)-3'-methylspiro(phthalido-3,9'-xanthene)-2'-ylamino]phenyl} propane (Compound No. VI-1) was replaced by 3-(N-cyclohexyl-N-methylamino)-6-methyl-7-anilinofluoran.

The test results are shown in Table 1.

TABLE 1

| Example No. | Item | Color density of color-developed images | Color density of color-erased images | Heat-resistance (color density retention) (%) | Moisture-resistance (color density retention) (%) |
|---|---|---|---|---|---|
| Example | 1 | 1.40 | 0.11 | 89 | 81 |
| | 2 | 1.38 | 0.12 | 85 | 78 |
| | 3 | 1.36 | 0.12 | 85 | 77 |
| | 4 | 1.39 | 0.10 | 91 | 83 |
| | 5 | 1.40 | 0.11 | 88 | 82 |
| | 6 | 1.32 | 0.11 | 86 | 80 |
| | 7 | 1.34 | 0.10 | 89 | 81 |
| Comapra-tive Example | 1 | 1.38 | 0.13 | 45 | 38 |
| | 2 | 1.37 | 0.12 | 51 | 42 |
| | 3 | 1.35 | 0.14 | 48 | 41 |

Table 1 early shows that in the thermosensitive reversible recording materials of Comparative Examples 1 to 3, in which dye precursor compounds different from those of the formula (IV) were used, the resultant color-developed images exhibited low color density retentions under a high temperature (50° C.) condition and a high humidity (90%, at 40° C.) condition, while the comparative recording materials have a high color-erasing property.

Compared with the comparative examples, the thermosensitive reversible recording materials of Example 1 to 7 in accordance with the present invention exhibited high color-developing and erasing properties, the resultant colored images had a high density and a high heat resistance at 50° C. and a high moisture resistance at a humidity of 90% at 40° C.

The thermosensitive reversible recording material of the present invention can record colored images on a white ground with a high contrast, and the colored images exhibit high heat resistance and moisture resistance and thus can be retained over a long period and can be easily erased by heating. Therefore, the thermosensitive reversible recording material of the present invention is useful in practice.

We claim:

1. A thermosensitive reversible recording material comprising:

a substrate sheet, and a thermosensitive recording layer formed on the substrate sheet and comprising a colorless or light colored dye precursor and a color-developing agent capable of reversibly color-developing and erasing the dye precursor, in which (A) the color-developing agent comprises at least one member selected the class consisting of from the compounds of the formulae (I), (II) and (III):

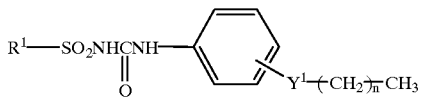

(I)

-continued (II)

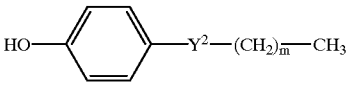

and (III)

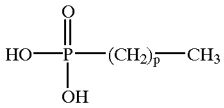

wherein $R^1$ represents a member selected from the class consisting of a naphthyl group, and a phenyl group substituted with at least one lower alkoxy group, $Y^1$ and $y^2$ respectively and independently from each other represent a member selected from the class consisting of divalent groups of the formulae:

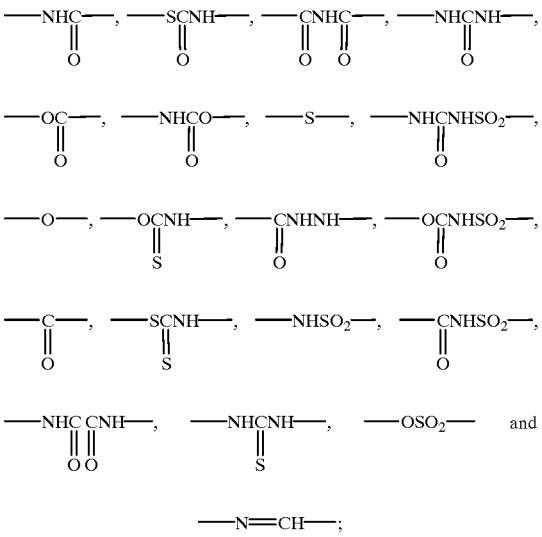

and n, m and p respectively and independently from each other represents an integer of 10 to 29, and (B) the dye precursor comprises at least member selected from the class consisting of the fluoran compounds of the formula (IV):

(IV)

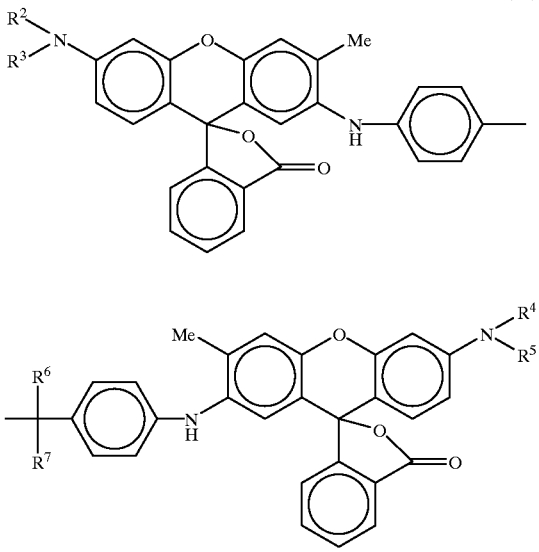

wherein $R^2{}_1$, $R^3$, $R^4$ and $R^5$ respectively and independently from each other represent a member selected from the group consisting of alkyl groups with 1 to 9 carbon atoms, cycloalkyl groups with 3 to 6 carbon atoms and a phenyl group which may be substituted with at least one substituent, and $R^6$ and $R^7$ respectively and independently from each other represent a member selected from the class consisting of alkyl group with 1 to 6 carbon atoms and a phenyl group, and Me represents a methyl group.

2. The thermosensitive reversible recording material as claimed in claim 1, wherein the fluoran compound of the formula (IV) for the dye precursor is of the formula (V):

(V)
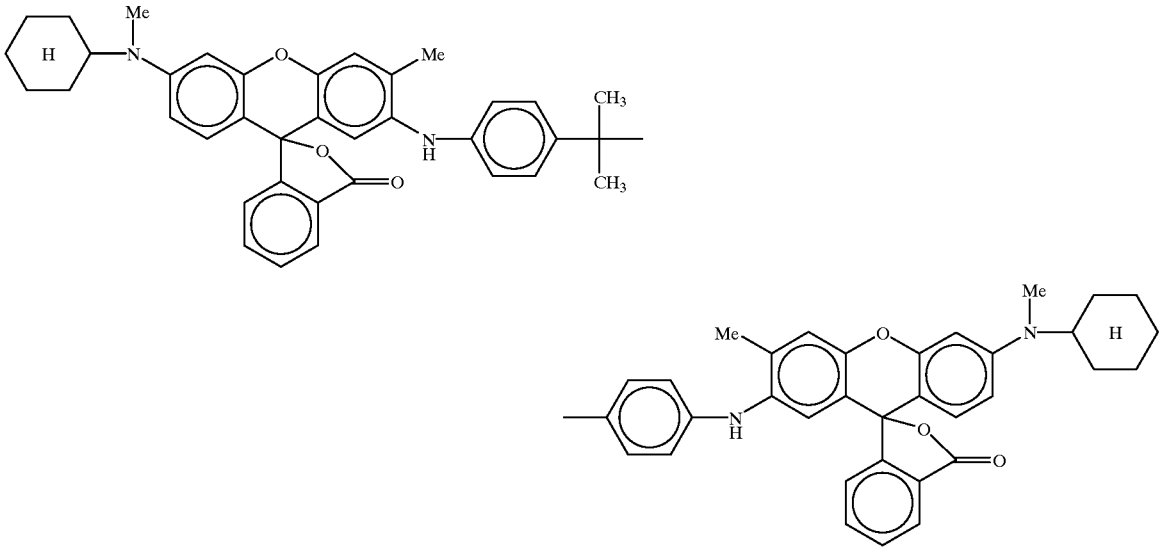
wherein Me is as defined above.
* * * * *